US006571412B1

(12) United States Patent
Wu

(10) Patent No.: US 6,571,412 B1
(45) Date of Patent: Jun. 3, 2003

(54) MULTIPLE TUBES COMBINATION STRUCTURE

(76) Inventor: Shang Neug Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/107,738

(22) Filed: Mar. 28, 2002

(51) Int. Cl.[7] ..... A47C 3/00
(52) U.S. Cl. ..... 5/658; 5/706
(58) Field of Search ..... 5/658, 706, 713, 5/710

(56) References Cited

U.S. PATENT DOCUMENTS 5,920,934 A * 7/1999 Hannagan et al. ..... 5/713
6,152,176 A * 11/2000 Lin ..... 137/625.21
6,253,402 B1 * 7/2001 Lin ..... 5/713
6,266,833 B1 * 7/2001 Lin ..... 5/713
6,332,760 B1 * 12/2001 Chung ..... 417/411
6,439,264 B1 * 8/2002 Ellis et al. ..... 137/596.2
6,483,264 B1 * 11/2002 Shafer et al. ..... 318/16

* cited by examiner

*Primary Examiner*—Teri Pham Luu

(57) ABSTRACT

A multiple tubes combination structure for being assembled with air tubes of an airbed is disclosed, wherein a plurality of tubes are assembled in a combinational structure. Each individual component of the combinational structure has a specific element having a predetermined configuration. Thereby, when it is desired to assemble the combinational structure, it is only necessary to assure the configurations of elements. No error occurs. Thereby, the multiple tubes combination structure has a beautiful outlook.

4 Claims, 6 Drawing Sheets

MULTIPLE TUBES COMBINATION STRUCTURE

FIELD OF THE INVENTION

The present invention relates to components used in airbeds, especially to a multiple tubes combination structure for being assembled with air tubes of an airbed, wherein each individual component of the combinational structure has a specific element having a predetermined configuration. Thereby, when it is desired to assemble the combinational structure, it is only necessary to assure the configurations of elements.

BACKGROUND OF THE INVENTION

A medical airbed has a plurality of airbags. Air is filled into the airbags. In the prior art, the body of the airbed is divided into several sections. The sections are inflated and vented alternatively. Thereby, the inflation condition of the airbed can be changed. There are a plurality of air tubes which are used to supply air to the airbags. Thus, the end of the air pump of the bed has a plurality of tubes for being connected with air pipes connected to the airbags. As a result, the assembling work of the airbed is complicated and thus it is often that some incorrect connections between the air pipes and tubes are induced. Thereby, the alternation of the operations of inflating air and venting air in the airbed is sometimes incorrect. Thereby, the patient lying on the bed will feel uneasy.

SUMMARY OF THE INVENTION

Accordingly, the primary object of the present invention is to provide a multiple tubes combination structure for being assembled with air tubes of an airbed, wherein a plurality of tubes are assembled in a combinational structure. Each individual component of the combinational structure has a specific element having a predetermined configuration. Thereby, when it is desired to assemble the combinational structure, it is only necessary to assure the configurations of elements. No error occurs. Thereby, the multiple tubes combination structure has a beautiful outlook.

The various objects and advantages of the present invention will be more readily understood from the following detailed description when read in conjunction with the appended drawing.

DETAILED DESCRIPTION OF THE PREFERRED EMBODIMENTS

Figure 1:
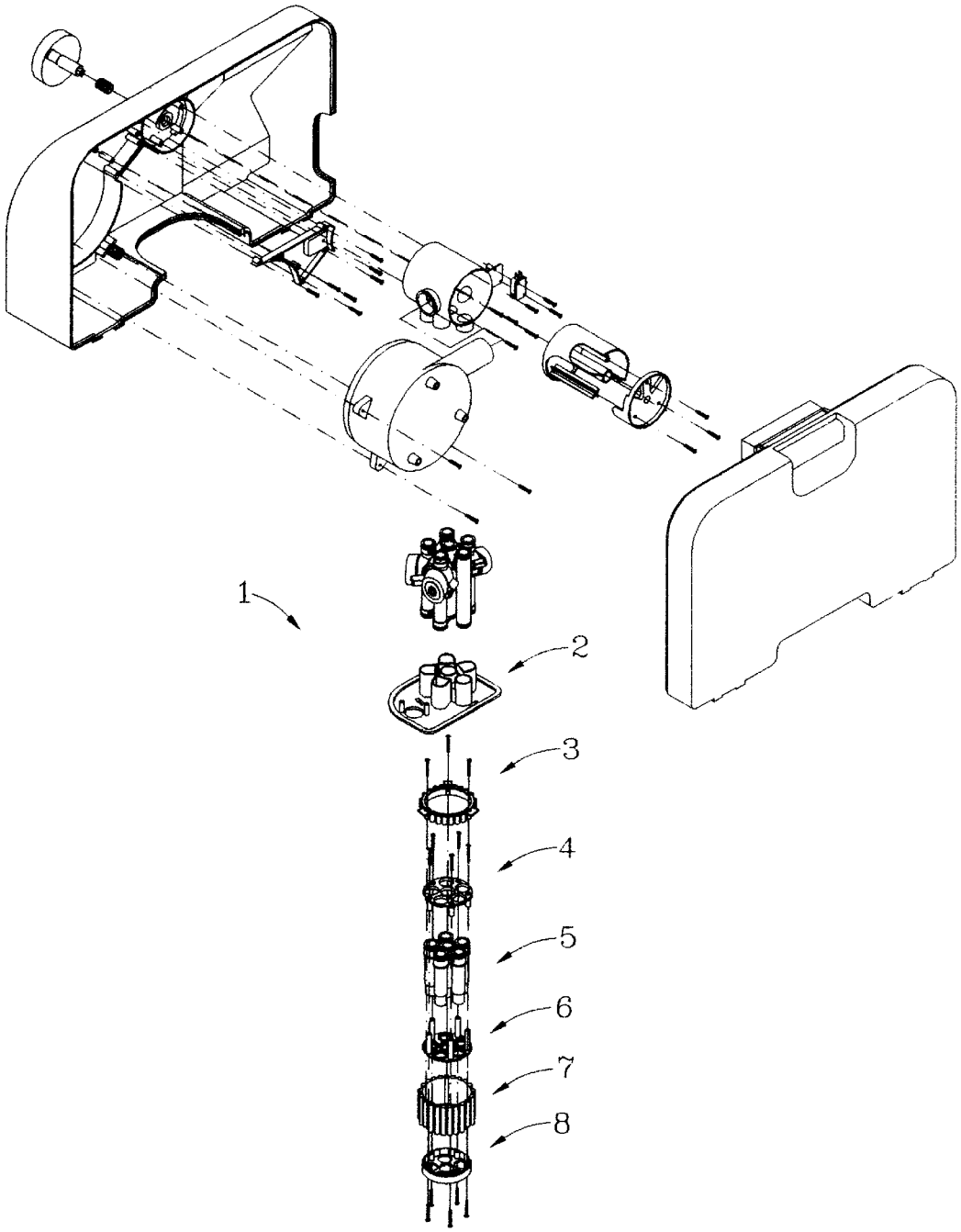
FIG. 1 is an exploded perspective view of the present invention.
Figure 2:
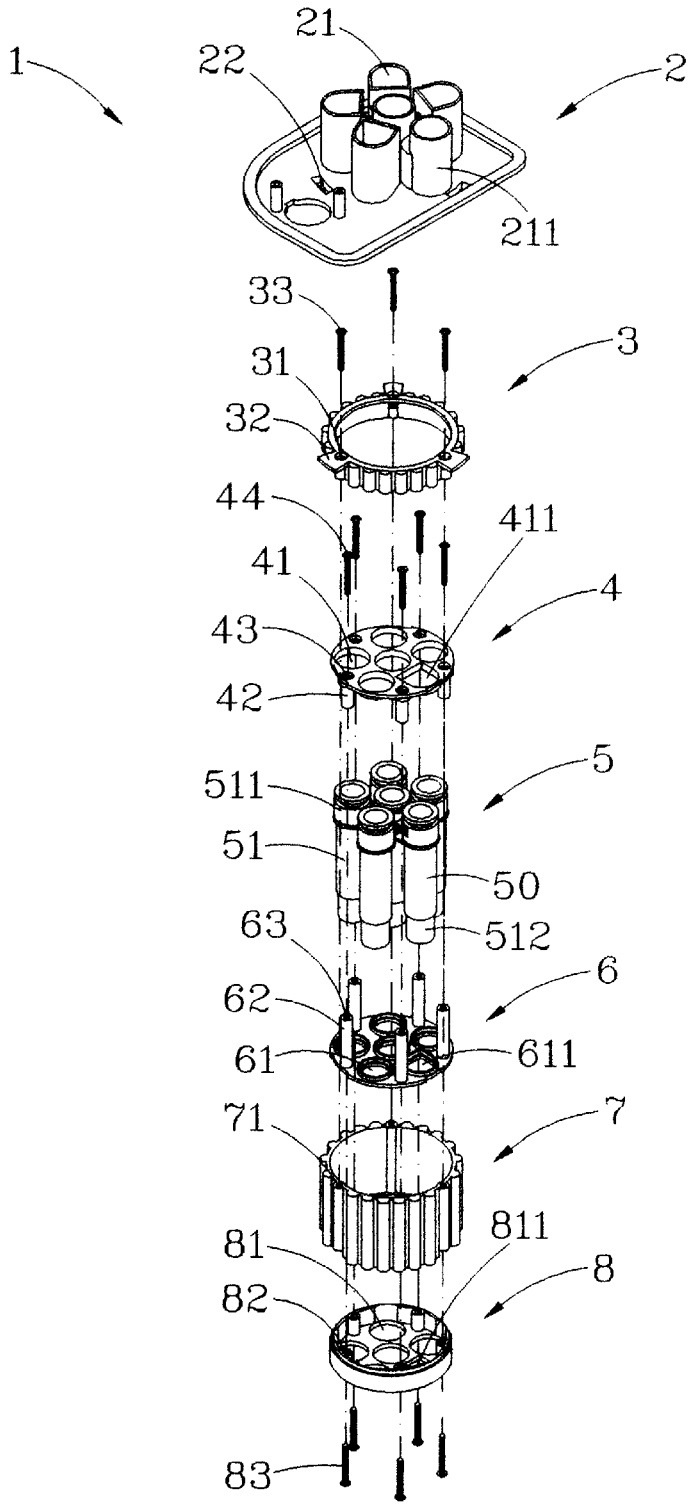
FIG. 2 is an exploded perspective view of the present invention, wherein the details of the present invention are illustrated.
Figure 3:
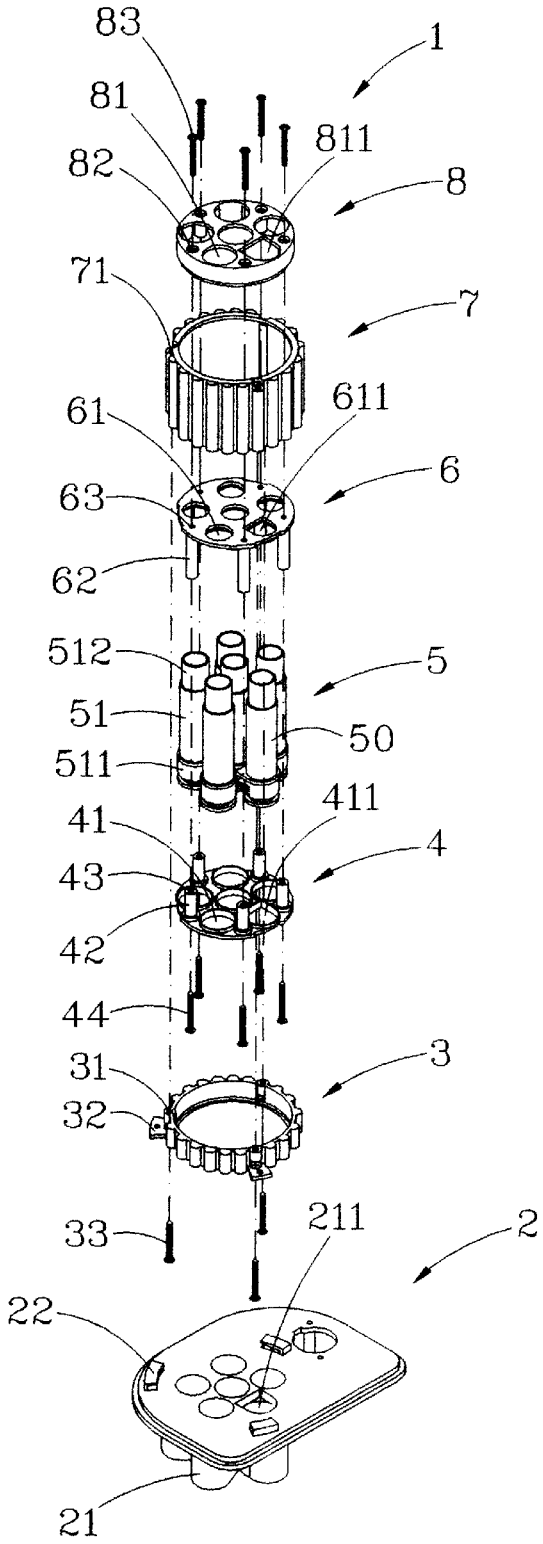
FIG. 3 is another exploded perspective view of the present invention.
Figure 4:
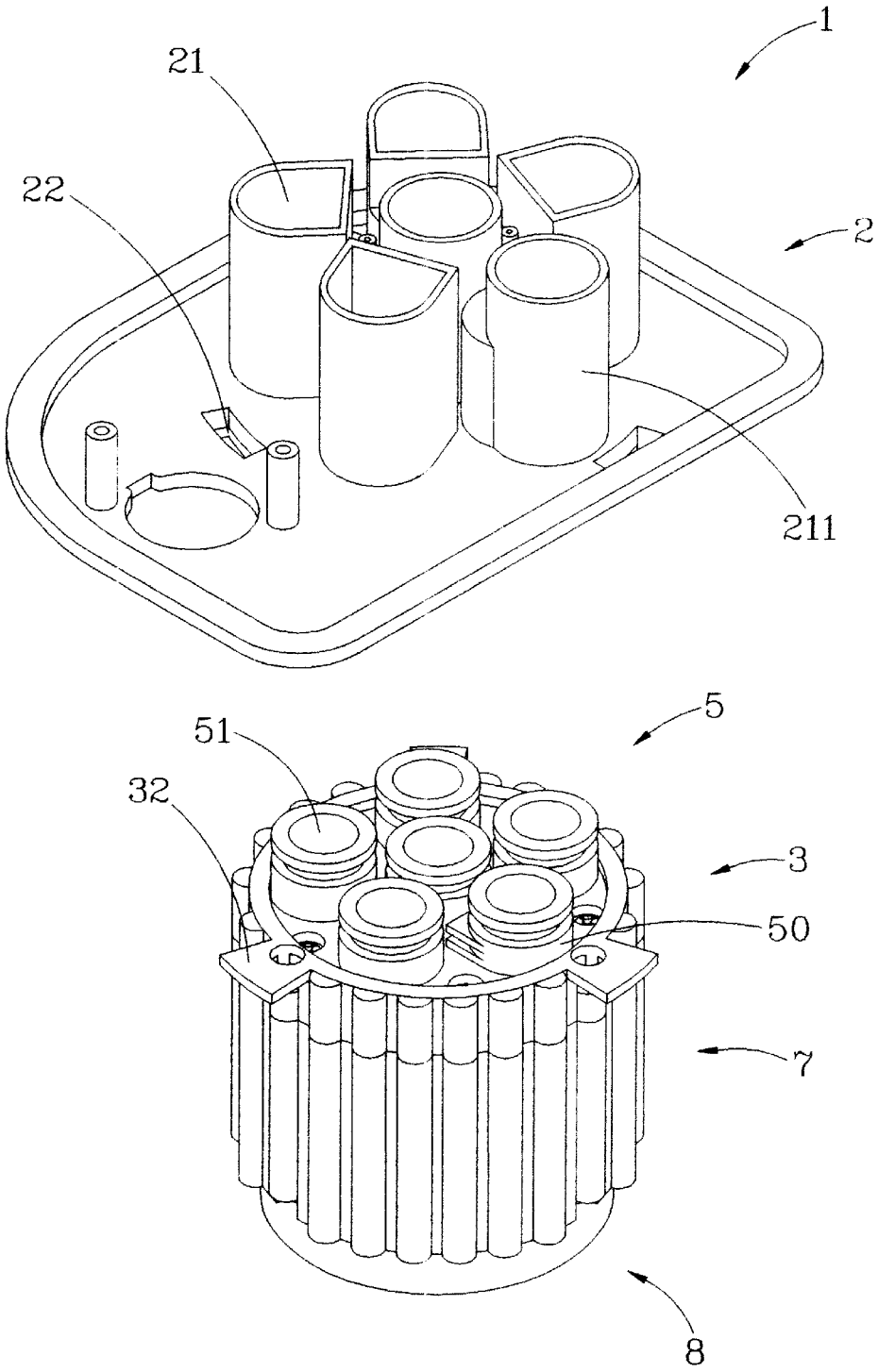
FIG. 4 is a partial exploded perspective view of the present invention.
Figure 5:
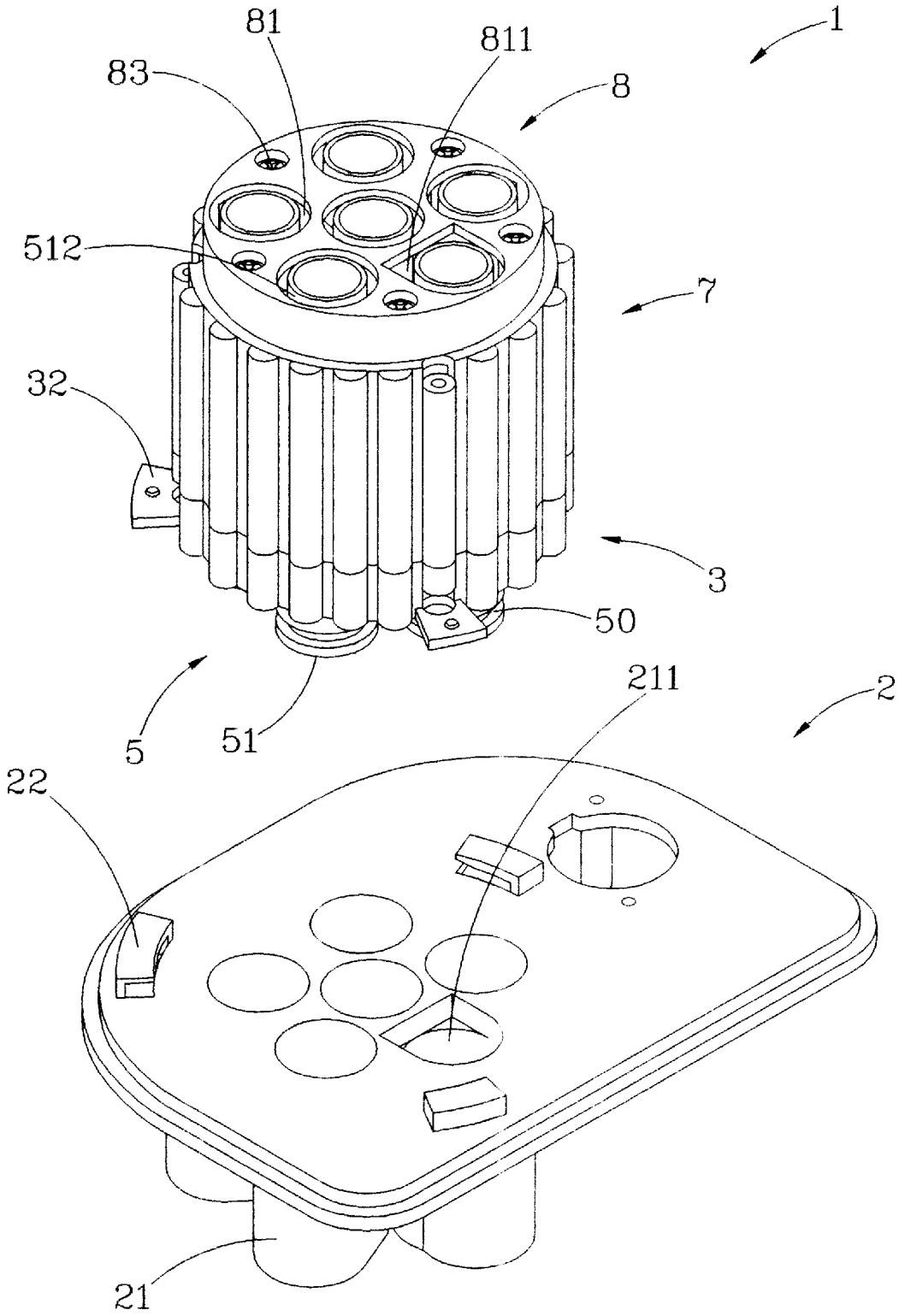
FIG. 5 is another partial exploded perspective view of the present invention.

Referring to appended drawings, the multiple tubes combination structure of the present invention is illustrated. In the following, one embodiment of the present invention will be described.

Referring to the appended drawings, the combinational structure 1 of multiple tubes includes a base 2, a buckle seat 3, a first connecting plate 4, a tube assembly 5, a second connecting plate 6, a toggle 7, and an outer buckle 8.

One lateral side of the base 2 is used to connect an air valve of an air supply pump. Another lateral side thereof is connected to the buckle seat 3. One side of the base has a plurality of tracks 22. The base has a plurality of penetrating tube bodies 21. One of the tubes is a positioning tube body 211 which has a special shape.

The buckle seat 3 is a hollow ring. A plurality of buckling plates 32 are arranged around an outer edge of the buckle seat 3. The number of the buckling plate 32 is equal to that of the tracks 22. The buckling plate 32 can be buckled in the track 22. Thereby, the buckling seat 3 can be combined to the base 2. A plurality of locking holes 63 are formed on the buckling seat 3.

The first connecting plate 4 is a round plate corresponding to the buckle seat 3. A plurality of through holes 41 are formed on the first connecting plate 4. The arrangement and number of the first opening 41 are identical to those of the tube bodies 21. One of the plurality of through holes 411 is a positioning through hole 411 having a predetermined shape for being inserted by the positioning tube body 211. One side of the first connecting plate 4 has a plurality of posts 42. A top of each post 42 has a locking hole 43.

The tube assembly 5 has a plurality of tubes 51. One of the tubes 51 is a positioning tube 50. The shape of the positioning tube 50 is like that of the positioning through hole 411. The upper and lower ends of each tube body 51 are installed with an upper buckling portion 511 and a lower buckling portion 512, respectively. The upper buckling portion 511 can be inserted into the opening 41 of the first connecting plate 4.

The second connecting plate 6 is a round plate approximately identical to that of the first connecting plate 4. A plurality of openings 61 corresponding to the openings 41 are formed on the second connecting plate 6. A positioning opening 611 having a predetermined shape is installed in the opening 61. The positioning tube 50 in the tube assembly 5 can be inserted into the positioning opening 611. A plurality of posts 62 are installed at one side of the second connecting plate 6. The top of each post 62 is installed with a locking hole 63.

A toggle 7 is a hollow tube. The toggle 7 can enclose the tube assembly 5. The outer periphery of the toggle 7 has a plurality of locking holes 71. The positions and number of the locking holes 71 are identical to those of the locking holes 31.

The outer buckle 8 has a shape and a structure approximately identical to those of the first connecting plate 4 and second connecting plate 6. A plurality of openings 81 are formed on the outer buckle 8. One of the openings 81 is a positioning opening 811 with a predetermined shape. Moreover, the outer buckle 8 has a plurality of locking holes 82 the number of which is equal to that of the locking holes 63.

In assembly, the tube assembly 5 can be buckled between the first connecting plate 4 and second connecting plate 6. Especially, the positioning tube 50 can be inserted between the positioning openings 411 and 611. Then the first connecting plate 4 and second connecting plate 6 are locked by screwing a plurality of screws into the locking holes 43. Then, the toggle 7 encloses the tube assembly 5. Then, screws 33 screws through the locking holes 31 so that the buckle seat 3 is locked to the toggle 7. Finally, the tube assembly 5 protruding from the first connecting plate 4 is buckled to the tube bodies 21 of the base 2. The buckling plates 32 are buckled to the tracks 22. Thereby, the assembly of the multiple tubes combination structure is complete.

The present invention has the following advantages and characteristics.

Figure 6:
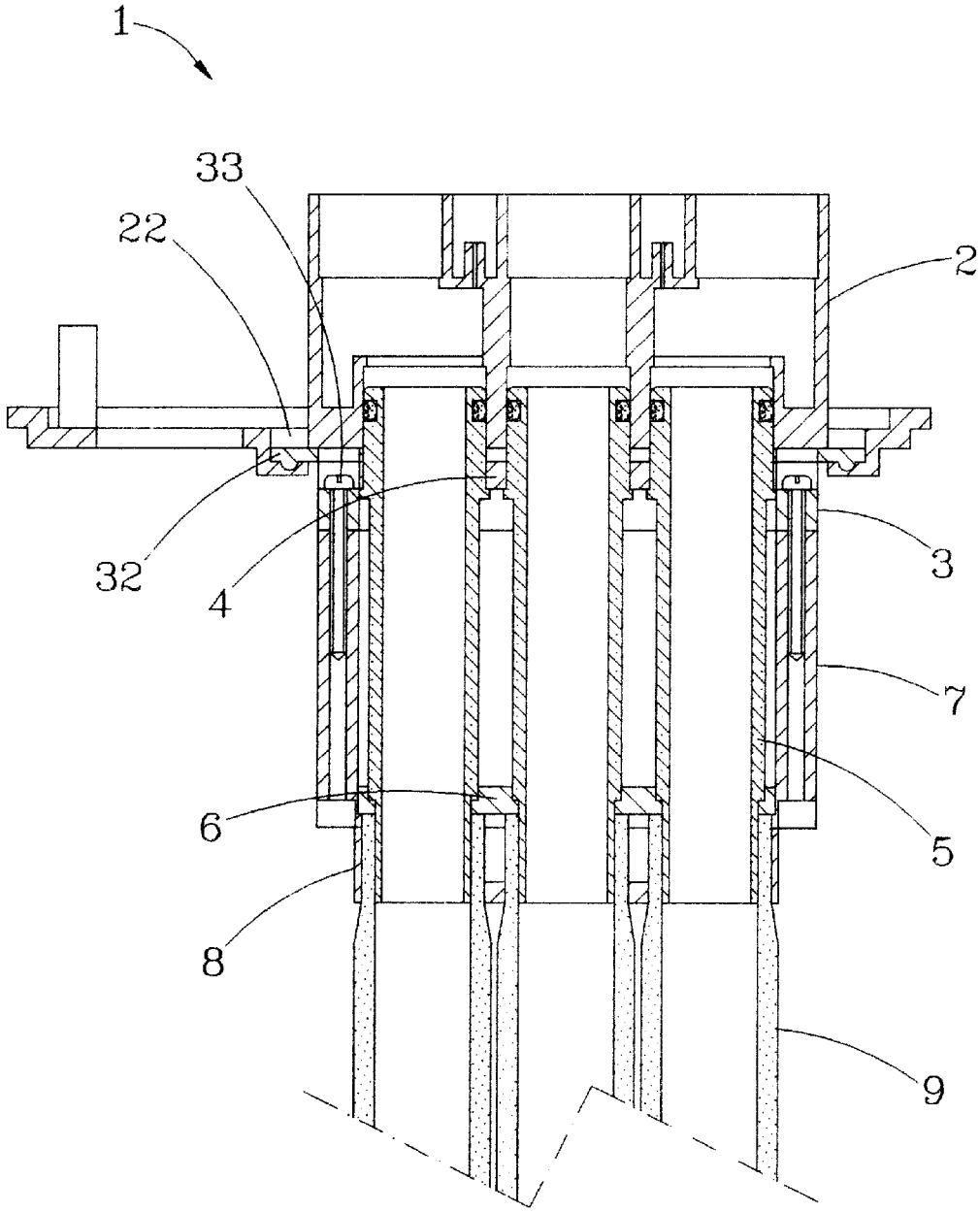
FIG. 6 is a partial structure view of the present invention.

1. The plurality of tube bodies 51 are cylinders and modulized. When it is desired to install the tube bodies 51 with the tube bodies 21 of the base 2. It is only necessary to assure the configurations of the positioning tubes 50 and 211. No error occurs, while conventionally, the tubes are assembled one by one. Thereby, the multiple tubes combination structure of the present invention has a beautiful outlook.
2. Referring to FIG. 6, when it is desired to combine the air tubes 9 to the present invention, the air tubes 9 are inserted to the protruding ends of the tube assembly 5. Then, the buckle 8 is assembled. By screwing the screws 83 through the locking holes 82, the buckle 8 is locked to the second connecting plate 6. By tightening the opening 81 with the buckling portions 512 of the tube body 51, the air tubes can be tightly engaged. Obviously, the assembly of the present invention is very easy.
3. Since the positioning tube 211, positioning openings 411, 611 and 811 all having special shapes are installed, each component can be assembled correctly. Therefore, a correct modulized structure can be obtained.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multiple tubes combination structure comprising: a base, a buckle seat, a first connecting plate, a tube assembly, a second connecting plate, a toggle, and an outer buckle, wherein one lateral side of the base is connected to an air valve of an air supply pump; another lateral side thereof is connected to the buckle seat, one side of the base has a plurality of tracks; the base has a plurality of penetrating tube bodies;

the buckle seat is a hollow ring; a plurality of buckling plates are arranged around an outer edge of the buckle seat; the buckling plate is buckled in the track; thereby, the buckling seat is combined to the base; a plurality of locking holes are formed on the buckling seat;

the first connecting plate is a round plate corresponding to the buckle seat; a plurality of through holes are formed on the first connecting plate; the arrangement and number of the first opening are identical to those of the tube bodies of the base; one side of the first connecting plate has a plurality of posts; a top of each post of the first connecting plate has a locking hole;

the tube assembly has a plurality of tubes;

the second connecting plate is a round plate approximately identical to that of the first connecting plate; a plurality of openings corresponding to the openings are formed on the second connecting plate; a plurality of posts are installed at one side of the second connecting plate; a top of each post of the second connecting plate is installed with a respective locking hole a toggle is a hollow tube; the toggle encloses the tube assembly; an outer periphery of the toggle has a plurality of locking holes; positions and number of the locking holes of the tube assembly are identical to those of the locking holes of the buckle seat; and the outer buckle has a shape and a structure approximately identical to those of the first connecting plate and second connecting plate; a plurality of openings are formed on the outer buckle; the outer buckle has a plurality of locking holes; the number of the locking holes of the outer buckle is equal to that of the locking holes of the second connecting plate;

wherein in assembly, at first, the tube assembly is buckled between the first connecting plate and second connecting plate; the first connecting plate and second connecting plate are locked by screwing a plurality of screws into the locking holes of the first connecting plate; then, the toggle encloses the tube assembly; then, screws penetrate through the locking holes of the buckle seat so that the buckle seat is locked to the toggle; finally, the tube assembly protruding from the first connecting plate is buckled to the tube bodies of the base; the buckling plates of the buckle seat are buckled to the tracks of the base; thereby, the assembly of the multiple tubes combination structure is completed.

2. The multiple tubes combination structure as claim in claim 1, wherein a selected one of the tube bodies of the base has a first predetermined shape; a selected one of the tubes in the tube assembly is a positioning tube with a second predetermined shape; a selected one of the openings of the first connecting plate is a positioning opening with a third predetermined shape; and a selected one of the openings of the second connecting plate is a positioning opening with a fourth predetermined shape; thereby, the multiple tubes combination structure is assembled correctly by identifying these selected elements.

3. The multiple tubes combination structure as claim in claim 1, wherein an upper and an lower ends of each tube of the tube assembly are installed with an upper buckling portion and a lower buckling portion, respectively; the upper buckling portion is inserted into the opening of the first connecting plate.

4. The multiple tubes combination structure as claim in claim 1, wherein the air tubes are inserted to the protruding ends of the tube assembly; then, the outer buckle is engaged with the air tube; by screwing the screws through the locking holes of the outer buckle, the buckle is locked to the second connecting plate; by tightening the opening of the outer buckle with the buckling portions of the tube of the tube assembly, the air tubes is tightly engaged.

* * * * *